United States Patent [19]

Jones

[11] Patent Number: 4,827,640

[45] Date of Patent: May 9, 1989

[54] GAMING TOKEN AND PROCESS THEREFOR

[76] Inventor: Bernard B. Jones, 3672 S. Highland, Las Vegas, Nev. 89103

[21] Appl. No.: 42,919

[22] Filed: Apr. 27, 1987

[51] Int. Cl.[4] ..... G09F 3/02

[52] U.S. Cl. ..... 40/27.5

[58] Field of Search ..... 40/27.5, 1.5, 1.6; 273/288, 290, 148 R; 206/0.8, 0.82; 63/18

[56] References Cited

U.S. PATENT DOCUMENTS

| | | | |
|---|---|---|---|
| 1,935,308 | 11/1933 | Baltzley | 40/27.5 |
| 2,683,526 | 7/1954 | Wheatley | 206/0.82 |
| 3,439,439 | 4/1969 | Stimson | 40/1.5 |
| 3,670,524 | 6/1972 | Korwin | 63/18 |
| 3,953,932 | 5/1976 | Graves | 40/27.5 |
| 3,968,582 | 7/1976 | Jones | 40/27.5 |
| 3,983,646 | 10/1976 | Howard | 40/27.5 |
| 4,399,910 | 8/1983 | Gutentag | 206/0.82 |
| 4,435,911 | 3/1984 | Jones | 40/27.5 |

*Primary Examiner*—John J. Wilson
*Assistant Examiner*—Cary E. Stone
*Attorney, Agent, or Firm*—John E. Benoit

[57] ABSTRACT

A method and apparatus relating to a gaming chip comprising a flat, preferably non-metallic, annular ring having a central opening therein and a plurality of spaced color regions. A disc support annular flange integral with the annular ring extends inwardly from the central opening substantially planar with one side of the ring so as to support one or a plurality of discs, such as coins. With the disc or discs in place, a capture ring of a geometrical dimension to fit within the central opening and cover the edge of the other side of the disc is placed in central opening on the other side of the disc or discs and secured to the annular ring by sonic welding. Two discs may be used in face-to-face relationship or a single disc of greater thickness may be used.

9 Claims, 2 Drawing Sheets

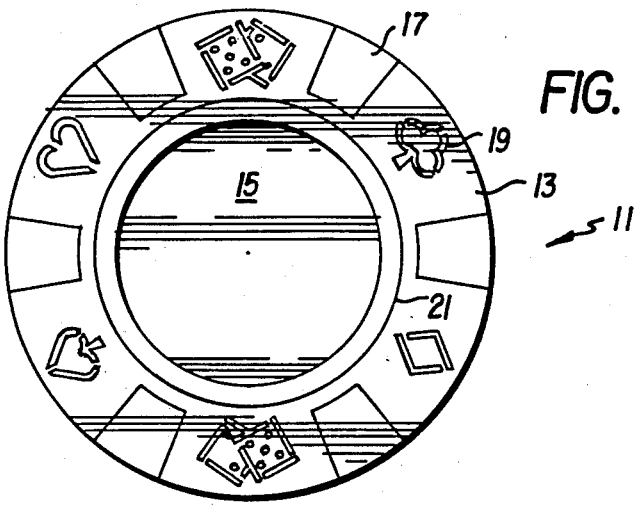
FIG. 1
FIG. 2
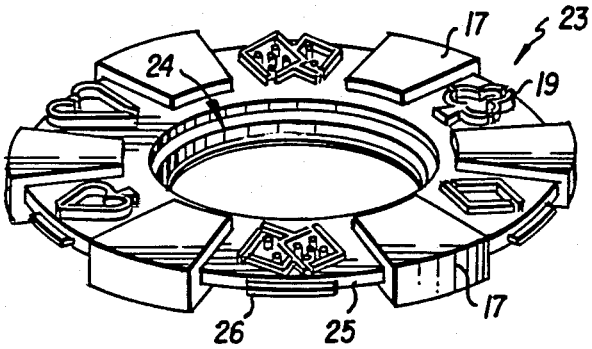
FIG. 6
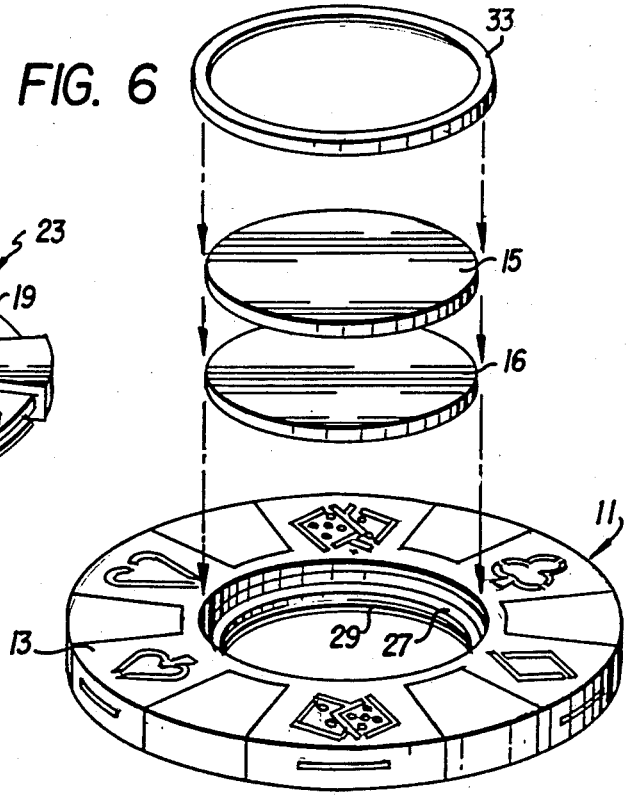
FIG. 7
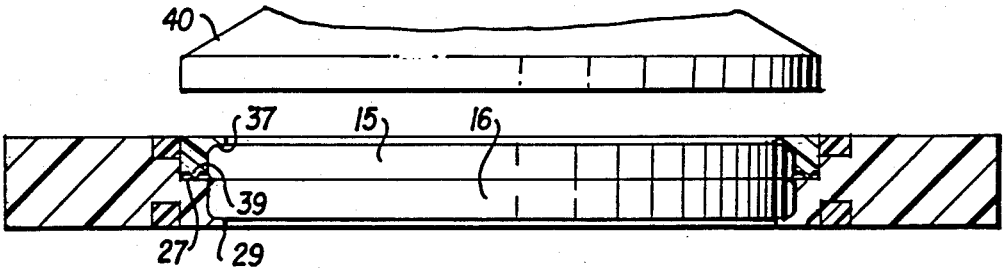

GAMING TOKEN AND PROCESS THEREFOR

This invention relates generally to denominational gaming tokens and, more particularly, to improvements in combination metal and plastic gaming tokens. These tokens are difficult to counterfeit and, also, may be used with precious metal coins.

BACKGROUND OF THE INVENTION

In my U.S. Pat. No. 3,968,582, issued on July 13, 1976, I disclosed and claimed nominal denominational gaming tokens (such as casino chips) and related injection-molding fabrication processes wherein these chips are constructed using total chip assembly techniques which make these chips or tokens very difficult to counterfeit. At the same time, however, novel tokens are produced with sharp, durable, and permanent indicia color lines thereon which render these tokens readily distinguishable as to denomination, origin, etc. at normal game distances by players and gaming house personnel alike. Thus, not only did my above-identified invention overcome smear problems associated with loss of color definition in "paint-on indicia" type casino tokens, but also limited the metal to cloth edge wear problems caused by metal-inlaid type casino chips. Additionally, this patented process makes token counterfeiting difficult by improving the total control which the final token assembler may exercise over the completed token.

In my U.S. Pat. No. 4,435,911, issued on Mar. 13, 1984, I disclosed an improvement in the above-identified invention. In this invention there is provided a gaming token which includes a relatively flat, non-metallic annular ring having parallel major surfaces and concentric minor edge surfaces, with the inner edge surface defining a central opening of the ring. Injection-molded indicia regions are selectively spaced around and on the annular ring, flush with the major surfaces thereof, and are bounded by good, sharp, and durable color lines. A coin-support annulus extends from the inner minor edge surface of the ring and into the central opening thereof by a predetermined distance. This coin-support annulus is integral with the non-metallic annular ring and is configured so as to receive, on each side thereof, back-to-back metal slugs or discs and permanently retain these metal slugs or discs in place on its opposing surfaces. When the discs are positioned on this coin-supported annulus located in the central opening of the ring and flush with the major surfaces of the annular ring, they are then bonded or spot-welded together at their abutting surfaces so that they become very difficult to remove by the average casino player or user of the token.

In the latter of these inventions it is quite obvious that, first, two discs must be used in order to accomplish the final token, since the two discs must be welded or otherwise secured together on opposite sides of the coin-support annulus. This obviously means that a single coin could not be used, nor could two precious coins be used, since the welding would be destructive of the precious coins.

Accordingly, it is an object of this invention to provide a new and improved combination metal and plastic gaming token which may use precious coins without destroying or harming the coins.

Another object of this invention is to provide a new and improved gaming token of a type described which may be constructed with either one or two metal discs or coins and yet not harm or destroy the coins, themselves.

A further object of this invention is to provide a new and improved combination metal and plastic gaming token wherein a single coin or dual coins are captured within the token by sonic welding of the plastic about the edges of the coin or coins.

Yet another object of the invention is to provide the above novel features of the present invention which require limited total fabrication piece parts and reduce overall fabrication costs.

These and other objects of the invention will become more apparent from the following description of the preferred embodiments thereof, as illustrated in the accompanied drawings.

BRIEF SUMMARY OF THE INVENTION

The present invention provides a method and apparatus which relates to a gaming chip comprising a flat, non-metallic annular ring having a central opening therein with a plurality of spaced color regions. A disc support annular flange integral with the annular ring extends inwardly from the central opening substantially planar with one side of the ring so as to support one edge of or a plurality of discs, such as coins. With the disc or discs in place, a capture ring of a geometrical dimension to fit within the central opening and cover the opposite edge of the disc or discs is placed in the central opening on the side opposite the annular flange and is secured to the annular ring by means such as sonic welding.

BRIEF DESCRIPTION OF THE DRAWINGS

FIG. 1 is a plan view of a completed token of the present invention;

FIG. 2 is a perspective view of the plastic preform used in constructing the token of FIG. 1;

FIG. 6 is an exploded view showing the assembly of the token of FIG. 1;

FIG. 7 is a showing of the coins and capture ring in place, ready for welding by a sonic-welder.

DETAILED DESCRIPTION OF THE PREFERRED EMBODIMENT

Figure 3:
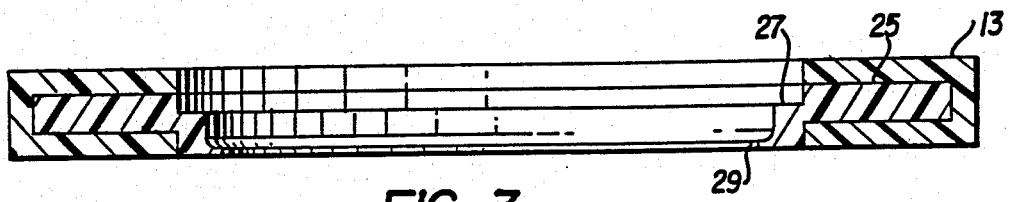
FIG. 3 is a sectional view taken through the line 33 of FIG. 2, showing the completed token.

Referring to the drawings, and specifically to FIG. 1, there is shown a completed metal and plastic gaming token 11 which includes a flat annular non-metallic ring member 13. Ring member 13 includes therein a plastic preform and molding material (which will be described subsequently) for forming the final token, which includes the coin or coins 15. Ring member 13 has an inner peripheral edge 21 which mates with a capture ring described below.

FIG. 2 discloses preform 23 having a central opening 24. This preform includes the post 17, as well as raised indicia indicated as gambling symbols 19. The indicias have a raised level wherein the tops are substantially planar with the tops of posts 17. Interconnecting the posts are annular rib members 25 which are integral with the indicia. Additionally, flanges 26 mate with and extend outwardly of the rib member so as to give a color at the outer edge of the finished token.

This plastic preform 23 can be stamped out or injection-molded in any desired configuration using well known injection-molding techniques. It could also be formed of die-casted metal. The thick vertical posts 17 and the thinner annular ribs 25 are adapted to receive an injection-molding compound containing the primary color of the token which differs from that of the preform. In this manner the preform defines selectively spaced colored patterns which may be used to indicate either the origin, ownership, or denomination of the token. The injection-molding of the primary color compound may be accomplished using, for example, the injection-molding process and apparatus disclosed in my above-identified U.S. Pat. No. 3,968,582.

Referring now to FIGS. 2 and 3, it can be seen that the original preform includes rib 25, a reduced section which creates ledge 27, and flange 29. In FIG. 3, the primary color molding compound referred to above has hardened and is shown as section 13, which completes the token as shown in FIG. 1 except for the coin and the capture ring. While this technique is preferable in producing a quality token, it could be produced as an integral molded plastic token or die-casted token and subsequently painted the desired colors.

Figure 4:
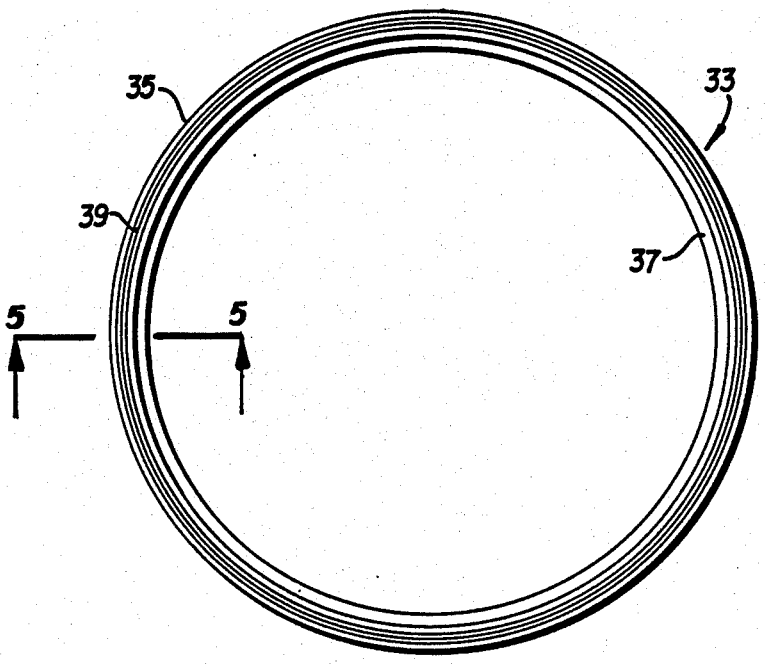
FIG. 4 is a plan view of the coin capture ring used in the present invention.
Figure 5:
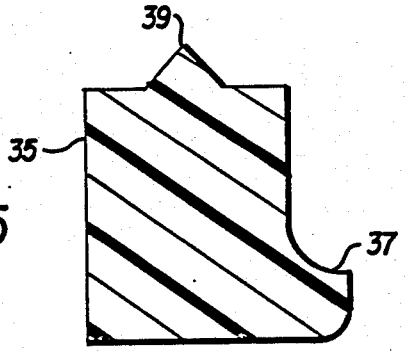
FIG. 5 is a section taken through line 55 of FIG. 4.

Turning to FIG. 4 and FIG. 5, which is a cross-sectional view taken through lines 5—5 of FIG. 4, capture ring 33 includes body 35 and flange 37 extending from one side thereof. The body also includes a tip 39 on the side opposite from flange 37 which is used in the sonic-welding process which will be subsequently described.

Referring to FIG. 6, there is disclosed the finished annular ring 13 with the coins 15 and 16 being placed therein and the capture ring 33 ready for proper placement. When the coins are placed therein, coin 16 will rest on flange 29 and coin 15 will rest on top of coin 16. When capture ring 33 is placed about the coins and fitted into the recess of the token, tip 39 rests against shelf 27. As indicated, sonic-welder 40 is placed over the token and is channeled so as to substantially mate above the capture ring 33. When the sonic welding process is initiated, the vibrations will melt tip 39 and the adjacent area so as to weld the ring against shelf 27. While sonic welding is preferable, the ring may also be secured in place by an adhesive. This obviously secures the coins in place within a flange on either side of the coins so that they cannot be removed without destroying the token. As will also be obvious, these coins have not been damaged in any way. This permits the use of a precious coins if desired. It should also be noted that a single coin having the width of two coins could also be used in the same process.

It is to be understood that the use of a circular coin is illustratively, only, since coins of various shapes (such as those shown in my U.S. Pat. No. 4,435,911) could be used with matching central openings in the token.

It is to be understood that the above description and drawings are illustrative, only, since modifications could be made without departing from the invention, the scope of which is to be limited only by the following claims.

I claim:

1. A gaming token comprising a substantially flat annular ring having a central opening therein, said ring comprising a disc support annular flange integral with said annular ring and extending inwardly from said central opening substantially planar with one side of said ring;

at least one flat metal disc within said central opening of said annular ring, said at least one disc being of a geometrical dimension such that the edge of said disc rests on said flange;

a capture ring of a geometrical dimension to fit within said central opening on the other side of said ring and cover the edge of said disc, said capture ring being of the same material as said substantially flat annular ring; and said capture ring being sonically welded to said annular ring.

2. The gaming token of claim 1 wherein said annular ring and said capture ring are of a non-metallic material.

3. The gaming token of claim 3 wherein said non-metallic material is plastic.

4. A gaming token comprising a substantially flat annular ring having a central opening therein, said ring comprising a disc support annular flange integral with said annular ring and extending inwardly from said central opening substantially planar with one side of said ring;

at least one flat metal disc within said central opening of said annular ring, said at least one flat metal disc being of a geometrical dimension such that the edge of said disc rests on said flange;

a capture ring of a geometrical dimension to fit within said central opening on the other side of said ring and cover the edge of said disc; and means for securing said capture ring to said annular ring;

a reduced diameter opening extending from one face of said annular ring into said central opening and terminating within said opening in a substantially flat ledge between said reduced diameter opening and said central opening, said reduced diameter opening being of a geometrical dimension and depth to encompass said disc; and said capture ring comprising an inner surface having a width substantially the same as said ledge whereby said inner surface of said capture ring is secured to said ledge; and a flange extending inwardly from the outer surface of said capture ring so as to encompass the edge of said disc.

5. A gaming token comprising a flat non-metallic annular ring having a central opening therein, said ring comprising an annular rib member;

a plurality of spaced color regions therein sharply defined in geometry by a molding compound of a sharply color, in intimate contact with said annular rib member;

a disc support annular flange integral with said annular ring and extending inwardly from said central opening substantially planar with one side of said ring;

at least one flat metal disc within said ring central opening of said annular ring, said at least one flat metal disc being of a geometrical dimension such that the edge of said disc rests on said flange;

a capture ring of a geometrical dimension to fit within said central opening on the other side of said ring and cover the edge of said disc, said capture ring being of the same material as said substantially flat annular ring; and said capture ring being sonically welded to said annular ring.

6. A gaming token comprising a flat non-metallic annular ring having a central opening therein, said ring comprising an annular rib member;

a plurality of spaced color regions therein sharply defined in geometry by a molding compound of a selected color, in intimate contact with said annular rib member;

a disc support annular flange integral with said annular ring and extending inwardly from said central opening substantially planar with one side of said ring;

at least one flat metal disc within said ring central opening of said annular ring, said at least one flat metal disc being of a geometrical dimension such that the edge of said disc rests on said flange;

a capture ring of a geometrical dimension to fit within said central opening on the other side of said ring and cover the edge of said dis; and means for securing said capture ring to said anular ring;

a reduced diameter opening extending from one face of said annular ring into said central opening and terminating within said opening in a substantially flat ledge between said reduced diameter opening and said central opening, said reduced diameter opening being of a geometrical dimension and depth to encompass said disc; and said capture ring comprising an inner surface having a width substantially the same as said ledge whereby said inner surface of said capture ring is secured to said ledge; and a flange extending inwardly from the outer surface of said capture ring so as to encompass the edge of said disc.

7. A process for fabricating a combination metal-and-plastic gaming token which comprises providing a single plastic annular ring having a central opening therein;

providing a support flange integral with said annular ring and extending inwardly from said central opening substantially planar with one side of said ring; placing at least one flat metal disc within said opening with the edge of said disc resting on said support flange;

placing a capture ring within said opening, said capture ring being of a geometrical dimension so as to cover the edge of said disc; and sonically welding said capture ring to said annular ring.

8. A gaming token comprising a substantially flat annular ring having a central opening therein, said ring comprising a disc support annular flange integral with said annular ring and extending inwardly from said central opening substantially planar with one side of said ring;

two substantially flat metal discs in face-to-face relationship within said central opening of said annular ring, said discs being of a geometrical dimension such that the edge of one of said discs rests on said flange;

a capture ring of a geometrical dimension to fit within said central opening on the other side of said ring and cover the edge of the other of said discs; and means for securing said capture ring to said annular ring.

9. A gaming token comprising a flat non-metallic annular ring having a central opening therein, said ring comprising an annular rib member;

a plurality of spaced color regions therein sharply defined in geometry by a molding compound of a selected color, in intimate contact with said annular rib member;

a disc support annular flange integral with said annular ring and extending inwardly from said central opening substantially planar with one side of said ring;

two substantially flat metal discs within said ring central opening of said annular ring, said discs being of a geometrical dimension such that the edge of one of said discs rests on said flange;

a capture ring of a geometrical dimension to fit within said central opening on the other side of said ring and cover the edge of the other of said discs; and means for securing said capture ring to said annular ring.

* * * * *